US007100238B2

(12) United States Patent
McCauley

(10) Patent No.: US 7,100,238 B2
(45) Date of Patent: Sep. 5, 2006

(54) BENDABLE EXTENSION ARM

(76) Inventor: Patrick McCauley, 4645 Cedar Ridge Pl., Oceanside, CA (US) 92056

( * ) Notice: Subject to any disclaimer, the term of this patent is extended or adjusted under 35 U.S.C. 154(b) by 0 days.

(21) Appl. No.: 10/713,495

(22) Filed: Nov. 14, 2003

(65) Prior Publication Data

US 2005/0102794 A1 May 19, 2005

(51) Int. Cl.
*A47B 95/02* (2006.01)

(52) U.S. Cl. ..... 16/110.1; 16/426; 16/427; 16/434; 74/544; 74/177.6; 74/172; 15/172; 15/144.1

(58) Field of Classification Search ..... 16/422, 16/426 X, 427 X, 429, 434 X, 108, 109; 74/544 X; 81/177.2 X, 177.6 X, 177.8, 81/177.9; 15/172 X, 144.1 X; 403/220, 403/229; 242/405.2, 405.3; 285/114, 115; 43/18.1 CT; 294/23, 24
See application file for complete search history.

(56) References Cited

U.S. PATENT DOCUMENTS

| | | | | | |
|---|---|---|---|---|---|
| 2,372,930 | A * | 4/1945 | Bovee | 81/64 |
| 2,510,198 | A * | 6/1950 | Tesmer | 248/229.25 |
| 3,203,285 | A * | 8/1965 | Schmidt | 81/177.6 |
| 3,357,035 | A * | 12/1967 | Ficke | 15/144.1 |
| 3,579,677 | A * | 5/1971 | Ullman | 7/100 |
| 3,585,885 | A * | 6/1971 | Carr | 81/57 |
| 3,737,187 | A * | 6/1973 | Pryor | 294/19.1 |
| 4,730,960 | A * | 3/1988 | Lewis et al. | 408/127 |
| 4,876,929 | A * | 10/1989 | Kozak | 81/57.43 |
| 5,150,495 | A * | 9/1992 | Discko et al. | 15/167.1 |
| 5,263,646 | A | 11/1993 | McCauley | |
| 5,479,951 | A * | 1/1996 | Denebeim | 132/265 |
| 5,671,497 | A * | 9/1997 | Abdo | 15/144.1 |
| 5,697,267 | A * | 12/1997 | Tsai | 81/59.1 |
| 5,732,606 | A * | 3/1998 | Chiang | 81/177.2 |
| 5,823,592 | A * | 10/1998 | Kalidindi | 294/24 |
| 6,105,620 | A | 8/2000 | Habert | |
| 6,122,792 | A * | 9/2000 | Roy | 15/104.2 |
| 2002/0066151 | A1 * | 6/2002 | Parker et al. | 15/172 |

* cited by examiner

*Primary Examiner*—Brian E. Glessner
*Assistant Examiner*—Mark Williams
(74) *Attorney, Agent, or Firm*—John R. Ross; John R. Ross, III

(57) ABSTRACT

A bendable extension arm. A stiffening wire having a first end and a second end is connected at its first end to a wire receptor and at its second end to another wire receptor. A sheath covers the stiffening wire and prevents over bending of the stiffening wire. In a preferred embodiment, attachment devices are connected to the wire receptors. For example, in one embodiment a paint brush is connected to one of the wire receptors and an extension pole is connected to the other wire receptor. In another preferred embodiment, the bendable extension arm is used as a bendable handle. The user can grab the bendable handle at one end and attach an attachment device to the other end of the bendable handle. The bendable handle can be bent as desired by the user.

20 Claims, 6 Drawing Sheets

BENDABLE EXTENSION ARM

BACKGROUND OF THE INVENTION

Extension arms are known. Painters commonly use extension arms to reach high areas on a wall or a tall ceiling. Also, extension arms are attached between the shower plumbing and the shower head so that the shower head can be positioned to meet the tastes of the individual taking a shower.

Prior art extension arms have adjustable knuckle joints that allow the user to adjust the angle of the extension. Loosening the joint, setting the desired angle, and then retightening the joint can be a time consuming and tedious process. Also, the joints can corrode and fail over time.

What is needed is a better extension arm.

SUMMARY OF THE INVENTION

The present invention provides a bendable extension arm. A stiffening wire having a first end and a second end is connected at its first end to a wire receptor and at its second end to another wire receptor. A sheath covers the stiffening wire and prevents over bending of the stiffening wire. In a preferred embodiment, attachment devices are connected to the wire receptors. For example, in one embodiment a paint brush is connected to one of the wire receptors and an extension pole is connected to the other wire receptor. In another preferred embodiment, the bendable extension arm is used as a bendable handle. The user can grab the bendable handle at one end and attach an attachment device to the other end of the bendable handle. The bendable handle can be bent as desired by the user.

DETAILED DESCRIPTION OF THE PREFERRED EMBODIMENTS

Figure 1:
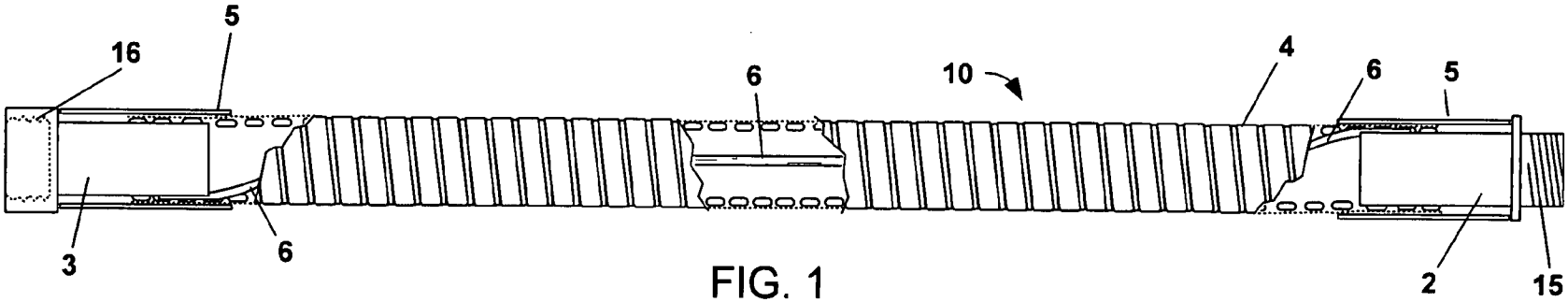
FIGS. 1 and 2 show a preferred embodiment of the present invention.
Figure 9:
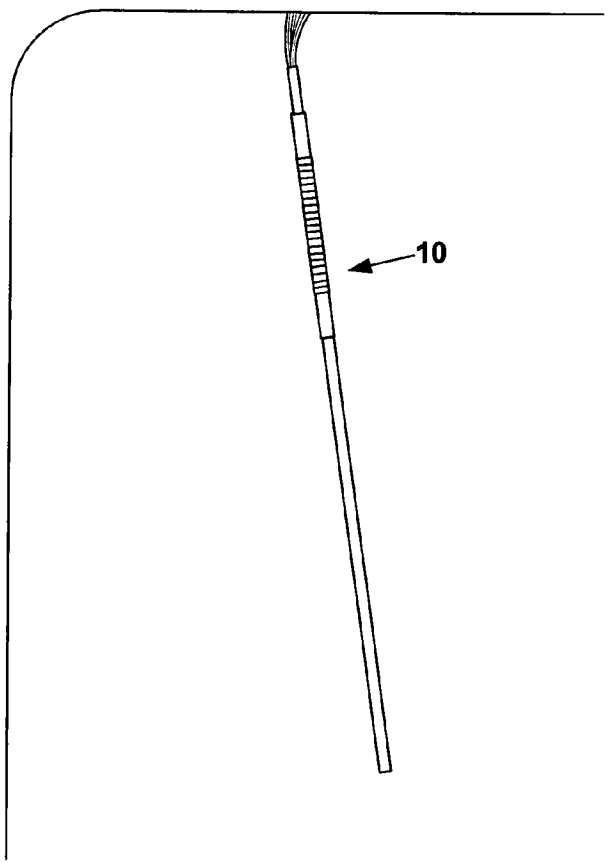
FIGS. 8–10 illustrate the utilization of a preferred embodiment of the present invention.
Figure 8:
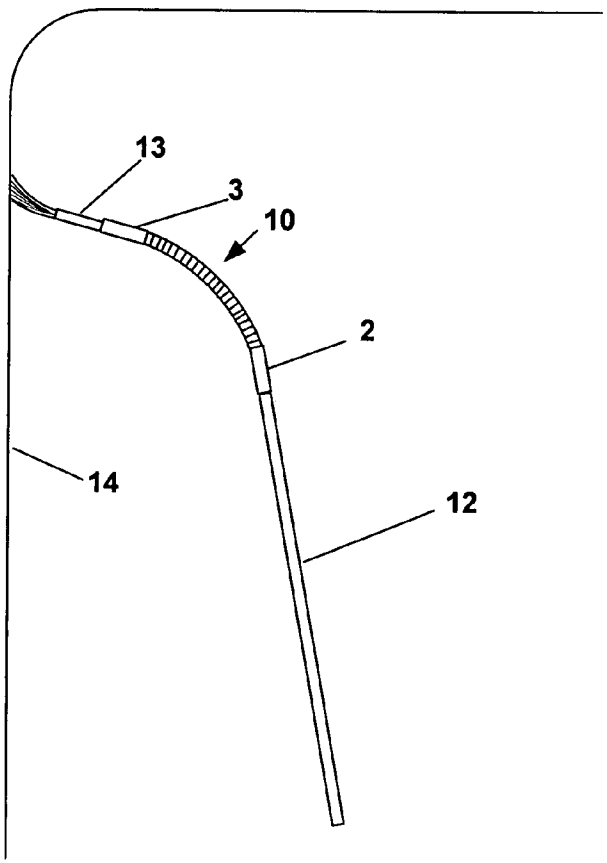
Figure 10:
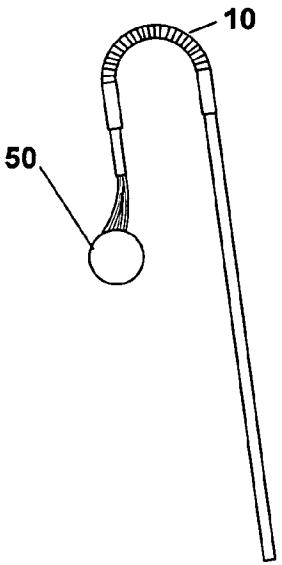

The present invention provides a bendable extension arm 10 (FIG. 1 and FIG. 8). By utilizing bendable extension arm 10, a user is able to easily customize the amount of bend applied to bendable extension arm 10 to accomplish the user's task. Bendable extension arm 10 is of sufficient strength and stiffness so that a user can easily bend bendable extension arm 10 to the desired amount. Also, bendable extension arm 10 will hold the applied amount of bend while the extension arm is being used. For example, in FIG. 8 the user has bent bendable extension arm 10 so that he can easily paint the top of wall 14. Then, in FIG. 10, the user has bent bendable extension arm 10 even further so that he can paint the top of pipe 50 where pipe 50 is high off the ground. In FIG. 9 the user has straightened bendable extension arm 10 so that he can paint the ceiling.

First Preferred Embodiment

FIG. 1 shows a first preferred embodiment of bendable extension arm 10. Stiffening wire 6 is connected to male wire receptor coupler 2 and female wire receptor coupler 3. External sheath 4 covers wire 6 and the internal ends of wire receptor couplers 2 and 3. In the preferred embodiment shown in FIG. 1, ferrules 5 are crimped over sheath 4, wire 6 and the internal ends of wire receptor couplers 2 and 3, thereby attaching sheath 4 and wire 6 to wire receptor couplers 2 and 3.

Stiffening Wire

In the preferred embodiment, stiffening wire 6 is 10 gage galvanized steel wire. In the preferred embodiment, wire 6 is approximately 15–18 inches long. Wire 6 has sufficient stiffness to allow a user of ordinary strength to easily bend bendable extension arm 10 to the desired shape while at the same time holding the desired shape while bendable extension arm 10 is being utilized. For example, FIG. 8 shows bendable extension arm 10 attached to the end of extension pole 12. Paint brush 13 is attached to the other end of bendable extension arm 10. In FIG. 8, a user has bent bendable extension arm 10 as shown so that the user can easily paint the top of wall 14. While paint brush 13 is being utilized to paint wall 14, bendable extension arm 10 retains its shape as shown.

Figure 2:
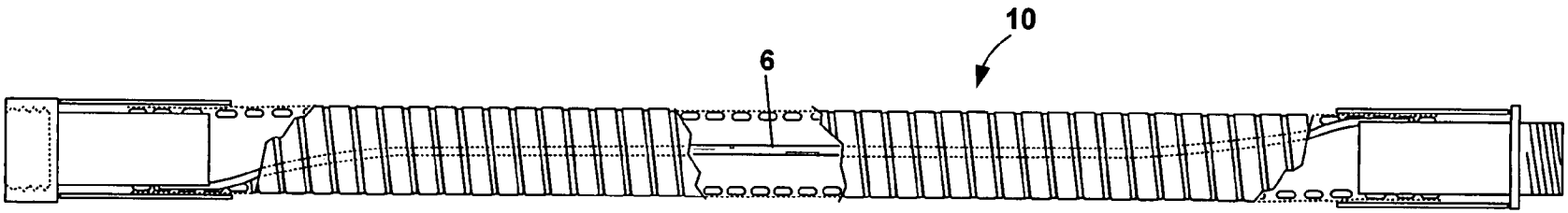

As shown in FIG. 2, wire 6 is preferably slightly twisted. By slightly twisting wire 6, the length of wire 6 is increased and the stiffness of bendable extension arm 10 is decreased. This makes it easier for the user to bend bendable extension arm 10.

Wire Receptor Couplers

Wire receptor coupler 2 has external threads 15 and wire receptor coupler 3 has internal threads 16. Wire receptor couplers 2 and 3 are utilized to connect bendable extension arm 10 to other devices. For example, in FIG. 8 bendable extension pole 12 is threaded onto external threads 15 (FIG. 1) of wire receptor coupler 2 and paint brush 13 is threaded onto internal threads 16 (FIG. 1) of wire receptor coupler 3.

Sheath

Figure 11:
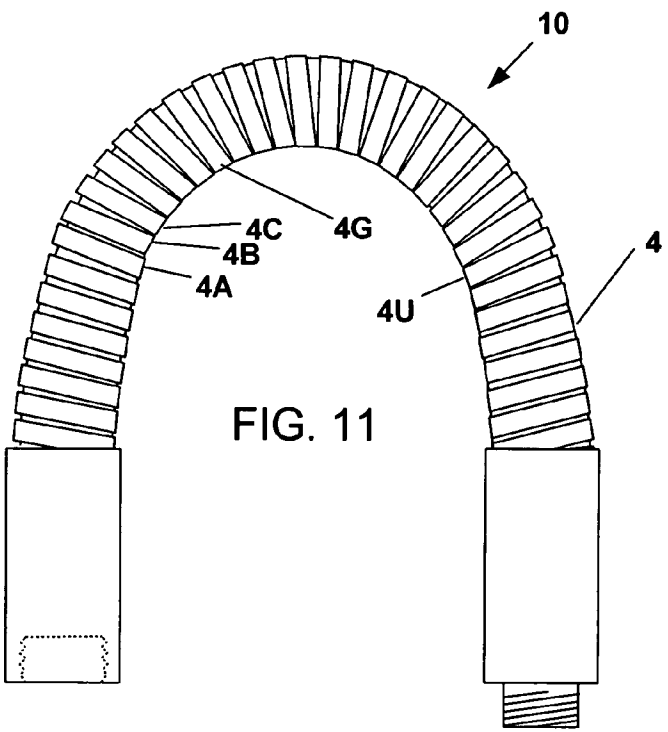
FIG. 11 shows a preferred embodiment of the present invention bent.

Sheath 4 is preferably a helically constructed bendable metal sheath. A preferred sheath 4 is available from Westflex Industrial with offices in National City, Calif., part no. AO515. It preferably has a diameter of approximately ¾ inches and is approximately 15–18 inches long. The helical metal construction of sheath 4 protects wire 6 and prevents over bending of wire 6. Over bending of wire 6 could significantly weaken wire 6 and even eventually cause it to break. For example, FIG. 11 shows bendable extension arm 10 being bent to approximately its maximum position. Links 4A–4U are compressed at the bottom of sheath 4 preventing any further bending movement.

Second Preferred Embodiment

Figure 3:
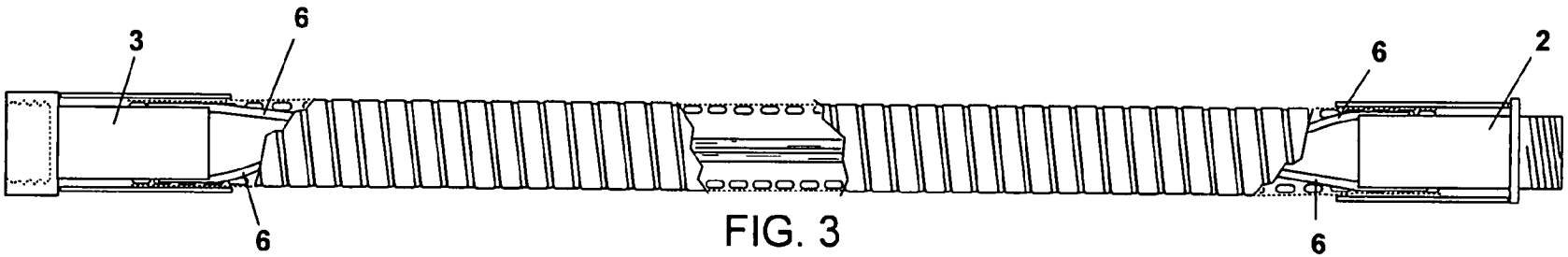
FIG. 3 shows another preferred embodiment of the present invention.

A second preferred embodiment is shown in FIG. 3. Two wires 6 are connected to wire receptor couplers 2 and 3. The utilization of two wires increases the strength and stiffness of bendable extension arm 10.

Third Preferred Embodiment

Figure 4A:
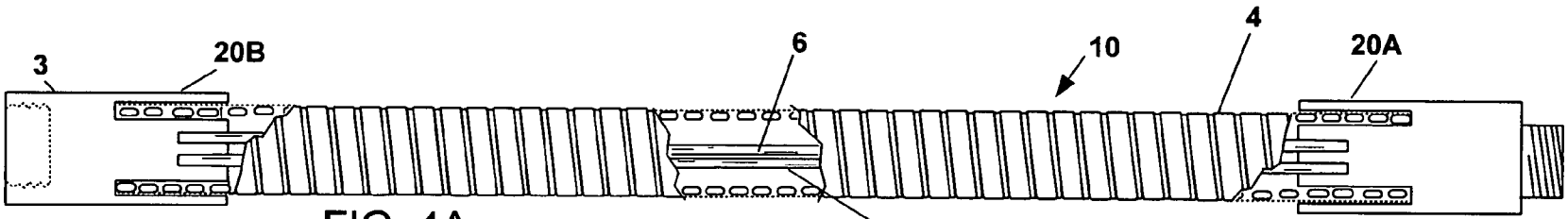
FIGS. 4A–5 show another preferred embodiment of the present invention.
Figure 4B:
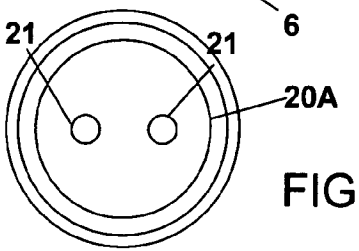
Figure 5:
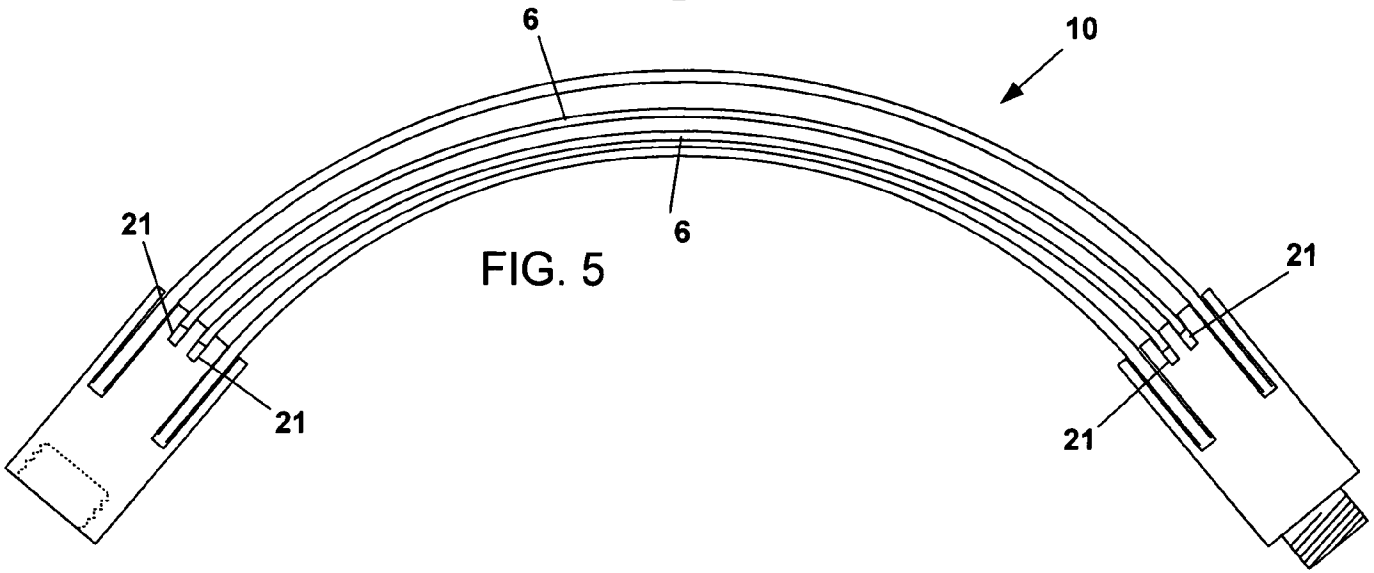

A third preferred embodiment is shown in FIGS. 4A–5. The third preferred embodiment includes wire receptor couplers 20A and 20B. Preferably, wire receptor couplers 20 are aluminum and are crimped onto sheath 4 in a fashion similar to that described above. Wire receptor couplers 20A and 20B include circular cutouts 21 (FIG. 4B) for receiving wires 6.

In the third preferred embodiment wires 6 slide back and forth in wire receptor couplers 20A and 20B as bendable extension arm 10 is bent. For example, as shown in FIG. 4A, when bendable extension arm 10 is straight, wires 6 extend to the ends of cutouts 21 (FIG. 4B). However, when bendable extension arm 10 is bent (FIG. 5), wires 6 slide part of the way out of cutouts 21. By allowing wires 6 to slide along cutouts 21, the stiffness of arm 10 is decreased making it easier for the user to bend bendable extension arm 10.

Fourth Preferred Embodiment

Figure 6:
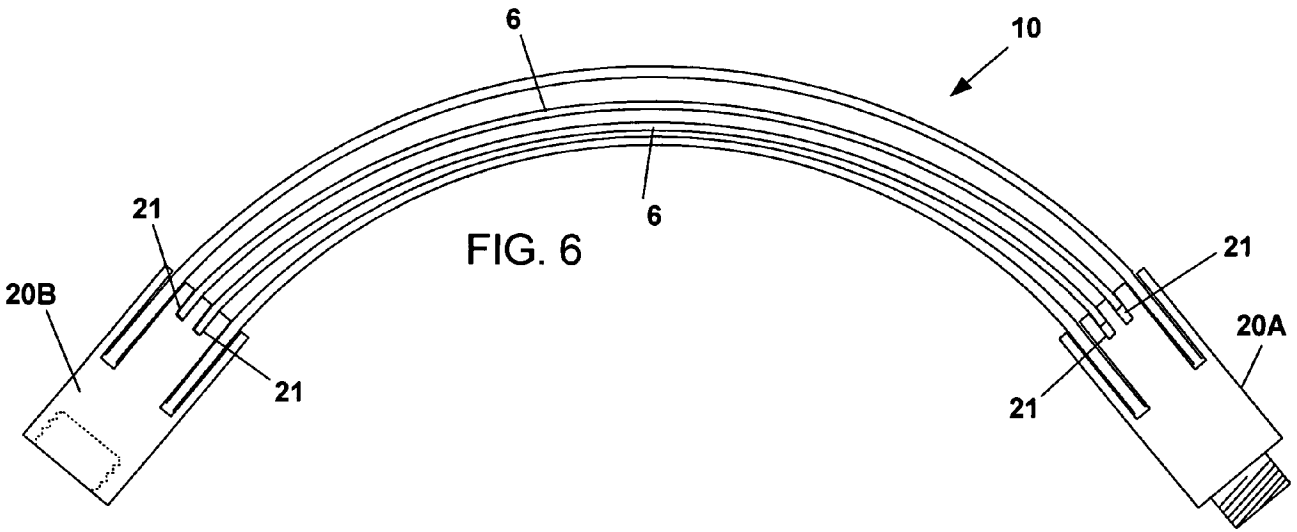
FIG. 6 shows another preferred embodiment of the present invention.

A fourth preferred embodiment is shown in FIG. 6. In the fourth preferred embodiment, wires 6 are tightly press fit and/or glued into receptor coupler 20B so that they do not slide, while in receptor coupler 20A wires 6 are allowed to slide. The fourth preferred embodiment is slightly stiffer than the third preferred embodiment.

Fifth Preferred Embodiment

Figure 7:
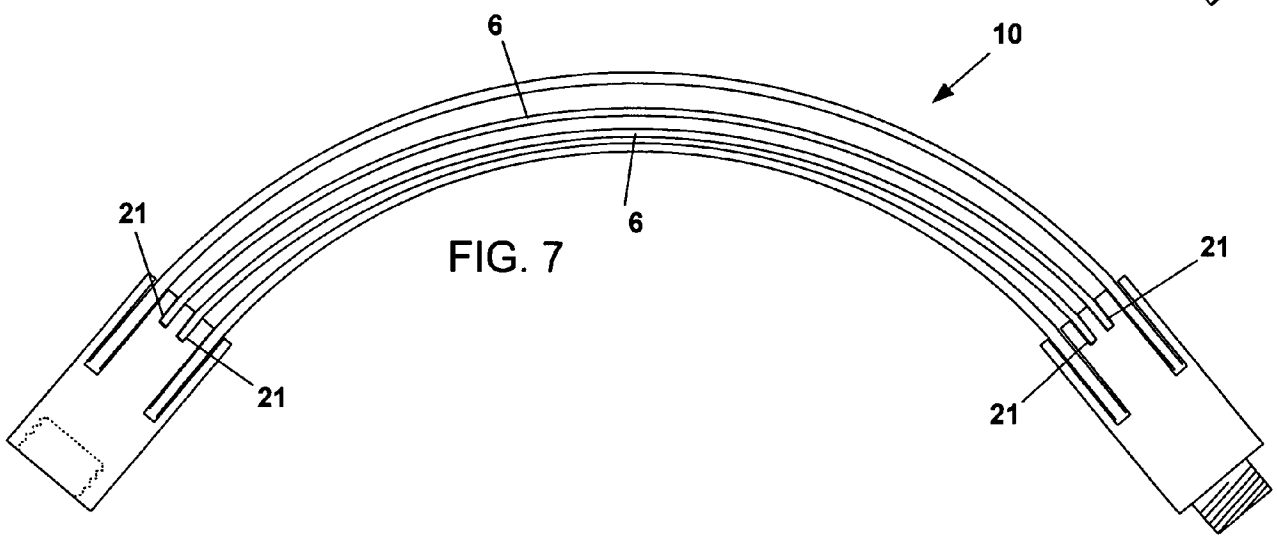
FIG. 7 shows another preferred embodiment of the present invention.

A fifth preferred embodiment is shown in FIG. 7. In the fifth preferred embodiment, wires 6 are tightly press fit and/or glued into wire receptor coupler 20B and wire receptor coupler 20A so that they do not slide. The fifth preferred embodiment is slightly stiffer than the fourth preferred embodiment.

Sixth Preferred Embodiment

Figure 14:
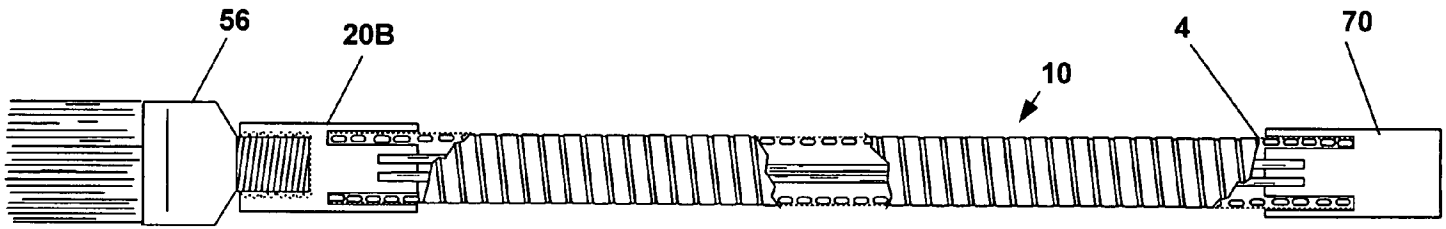
FIG. 14 shows another preferred embodiment of the present invention.

A sixth preferred embodiment is shown in FIG. 14. In the sixth preferred embodiment, wire receptor coupler 20A (FIG. 4A) has been replaced with wire receptor end piece 70. In the preferred embodiment, wire receptor end piece 70 is crimped onto sheath 4 in a fashion similar to that described above in reference to wire receptor coupler 20A. However, it should be noted that unlike wire receptor coupler 20A, wire receptor end piece 70 does not include external threads for connecting other devices. This is because for the sixth preferred embodiment shown in FIG. 4, bendable extension arm 10 is used as a handle rather than as an extension arm connected between an extension pole and a paint brush. In the sixth preferred embodiment, a user will grab bendable extension arm 10 at or near the portion of bendable extension arm 10 having wire receptor end piece 70. At the other end, the user will attach a separate device. For example, FIG. 14 shows paint brush 56 attached to wire receptor coupler 20B. In the sixth preferred embodiment, the user will use bendable extension arm 10 in a fashion similar to that described above. For example, while holding bendable extension arm 10, the user will be able to bend bendable extension arm 10 to the desired position and then paint with paint brush 56.

Figure 12:
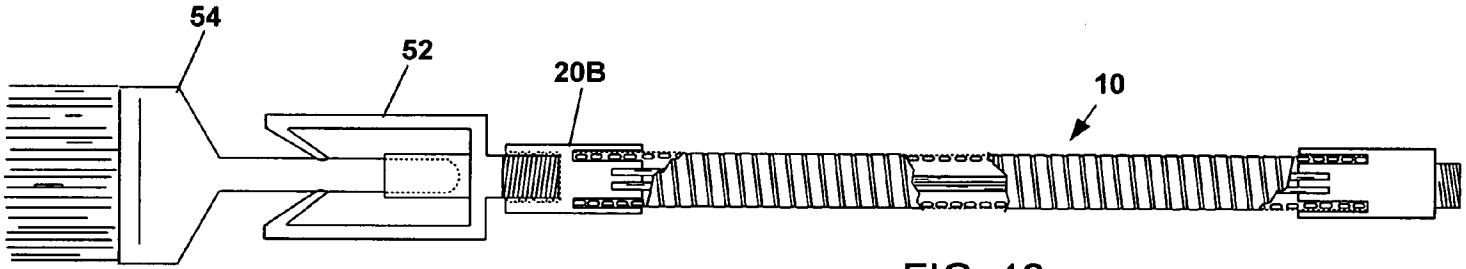
FIG. 12 shows another preferred embodiment of the present invention.
Figure 13:
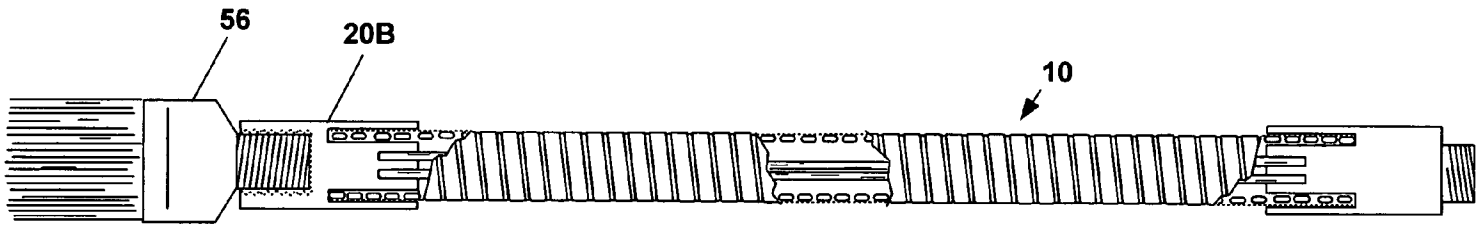
FIG. 13 shows another preferred embodiment of the present invention.

While the above description contains many specifications, the reader should not construe these as limitations on the scope of the invention, but merely as exemplifications of preferred embodiments thereof. Those skilled in the art will understand that many other possible variations are within its scope. For example, although the above preferred embodiments just showed examples of one or two stiffening wires 6 being used, it would be possible to utilize more stiffening wires 6. For example, three or four stiffening wires 6 could be used. Also, although the above description described wire 6 as being 10 gage galvanized steel wire, wire 6 could be fabricated from a variety of different types of wire having various gages. For example, wire 6 could be an 8 gage or a 14 gage galvanized steel wire. Also, even though the above preferred embodiments showed a male coupler and a female coupler each attached to and end of bendable extension arm 10, it would also be possible to attach two male couplers to bendable extension arm 10 or two female couplers to bendable extension arm 10. Also, it was stated above that wire receptor couplers 20A and 20B are aluminum and are crimped onto sheath 4. However, it would also be possible to fabricate wire receptor couplers from plastic and then attach the plastic receptor couplers to sheath 4 by melting them onto sheath 4. Also, FIGS. 12 and 13 show alternate ways to connect a paint brush to bendable extension arm 10. In FIG. 12 plastic paint brush gripper 52 is threaded onto wire receptor coupler 20B. Then, paint brush 54 is pushed into plastic paint brush gripper 52 where it is retained by plastic paint brush gripper 52. Alternatively, rather than plastic, paint brush gripper 52 can be fabricated from a variety of other materials, such as steel. In FIG. 13, brush 56 is threaded onto wire receptor coupler 20B. Also, although FIG. 8 showed a paint brushed attached to the end of bendable extension arm 10, other types of devices could also be attached to the end of bendable extension arm 10. For example, a hedge trimmer or a broom could be attached to the end of bendable extension arm 10. Accordingly the reader is requested to determine the scope of the invention by the appended claims and their legal equivalents, and not by the examples which have been given.

I claim:

1. A bendable extension arm for extending a user's reach while at least one tool is connected, said extension arm comprising:

A. a deformable stiffening wire sufficiently deformable to be easily deformed by the hands of said user but stiff enough to resist further bending in the course of tool usage, said stiffening wire defining a first end and a second end, B. a first wire receptor attached to said first end, said first end comprising an attachment means for attaching a tool, C. a second wire receptor attached to said second end, D. a sheath covering said stiffening wire for preventing over bending of said stiffening wire, and E. two ferrules attaching together said stiffening wire, said sheath and said first wire receptor and said second wire receptor, wherein said extension arm may be bent by hands of said user into desired shapes up to a bending limit determined by said sheath but remain stiff enough in said desired shapes to resist further bending during tool usage, and wherein substantially all resistance to bending during tool usage below said bending limit is provided by said stiffening wire.

2. The bendable extension arm as in claim 1, wherein said stiffening wire is a 10 gage galvanized metal wire.

3. The bendable extension arm as in claim 1, wherein said at least one tool comprises:

A. a paint brush, and

B. an extension pole.

4. The bendable extension arm as in claim 1, wherein said attachment means are threads.

5. The bendable extension arm as in claim 1, wherein said stiffening wire is rigidly attached to said first wire receptor and said second wire receptor.

6. The bendable extension arm as in claim 1, wherein at least one of said first end or said second end is slidingly attached to either one or both of said first wire receptor and said second wire receptor.

7. The bendable extension arm as in claim 1, wherein said first wire receptor and said second wire receptor are couplers for receiving said first end and said second end of said stiffening wire and for connecting separate devices.

8. The bendable extension arm as in claim 1, wherein at least one of said first wire receptor or said second wire receptor comprises a means for slidingly receiving said stiffening wire.

9. The bendable extension arm as in claim 1, wherein said sheath is helically constructed bendable metal sheath.

10. The bendable extension arm as in claim 1, wherein said two ferrules crimp said stiffening wire, said sheath and said first wire receptor or said second wire receptor.

11. The bendable extension arm as in claim 1, wherein said stiffening wire is a plurality of stiffening wires.

12. The bendable extension arm as in claim 1, wherein said bendable extension arm is a bendable handle.

13. The bendable extension arm as in claim 12, wherein said bendable handle comprises a:

A) a hand receiving end, and

B) a device attachment end, wherein a user grabs said handle at said hand receiving end and wherein a tool is attached to said handle at said device attachment end.

14. The bendable arm as in claim 13, wherein said tool is a paint brush.

15. The bendable extension arm as in claim 1, wherein said stiffening wire permits said bendable extension arm to be bent to a desired shape, and wherein said stiffening wire holds said desired shape and prevents said bendable extension arm from bending while said bendable extension arm is utilized.

16. The bendable extension arm as in claim 1, wherein a separate locking device is not necessary to maintain a desired shape when said bendable extension arm is being utilized for extending a user's reach.

17. The bendable extension arm as in claim 16, wherein not having to utilize a separate locking device to maintain said desired shape allows for said bendable extension arm to be utilized instantly to extend the user's reach after said bendable extension arm is bent to said desired shape.

18. The bendable extension arm as in claim 1, wherein said bendable extension arm is moved by the user's hand during tool usage.

19. The bendable extension arm as in claim 1, wherein said tool is a paint brush.

20. The bendable extension arm as in claim 1, wherein said tool is selected from a group consisting essentially of: paint brush, extension pole, hedge trimmer, and broom.

* * * * *